US005110371A

United States Patent [19]

Moriyama et al.

[11] Patent Number: 5,110,371

[45] Date of Patent: May 5, 1992

[54] ALUMINUM ALLOYS FOR FORMING COLORED ANODIC OXIDE FILMS THEREON AND METHOD FOR PRODUCING A SHEET MATERIAL OF THE ALLOY

[75] Inventors: Takeshi Moriyama; Katsuji Ogawa; Fumio Ohtake; Akito Nishizawa, all of Aichi, Japan

[73] Assignee: Nippon Light Metal Company, Ltd., Tokyo, Japan

[21] Appl. No.: 727,210

[22] Filed: Jul. 9, 1991

[30] Foreign Application Priority Data

Mar. 18, 1991 [JP] Japan ..... 3-077159

[51] Int. Cl.[5] ..... C22F 1/04; C22C 21/02

[52] U.S. Cl. ..... 148/691; 148/437; 148/440; 420/544; 420/548; 420/549; 420/550; 205/325

[58] Field of Search ..... 420/544, 548, 549, 550; 148/11.5 A, 437, 440; 204/29, 58

[56] References Cited

U.S. PATENT DOCUMENTS 4,836,863 6/1989 Matsuo et al. ..... 148/11.5 A

FOREIGN PATENT DOCUMENTS 60-63348 4/1985 Japan ..... 420/548

*Primary Examiner*—H. Dean
*Assistant Examiner*—Robert R. Koehler
*Attorney, Agent, or Firm*—Armstrong, Nikaido, Marmelstein, Kubovcik and Murray

[57] ABSTRACT

An aluminum alloy consists of, by weight, from 0.08 to 0.50 percent silicon, from 0.15 to 0.90 percent iron, the weight ratio of iron to silicon being from 1.4 to 2.2, and the remainder aluminum, intermetallic compounds of α-type Al-Fe-Si system being contained in the alloy. A light gray oxide film is formed on the alloy by anodic treatment.

5 Claims, 1 Drawing Sheet

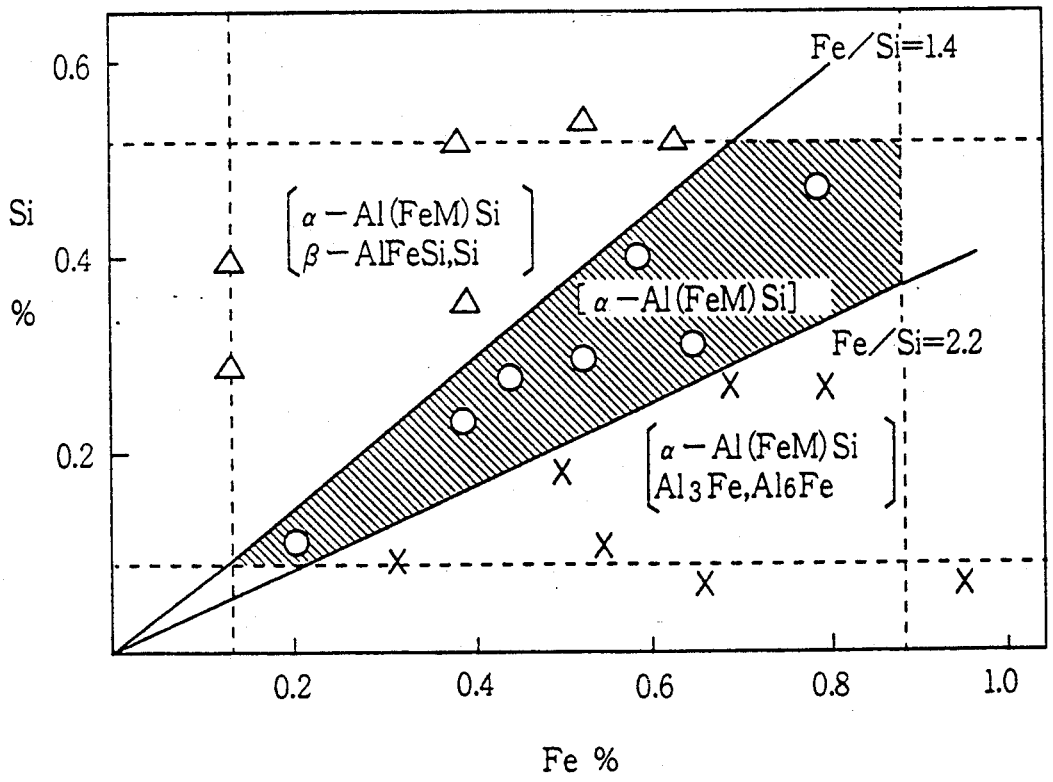
Fe/Si=1.4
Fe/Si=2.2
α−Al(FeM)Si
β−AlFeSi,Si
[α−Al(FeM)Si]
α−Al(FeM)Si
Al3Fe,Al6Fe
Si %
0.6
0.4
0.2
0.2
0.4
0.6
0.8
1.0
Fe %

ALUMINUM ALLOYS FOR FORMING COLORED ANODIC OXIDE FILMS THEREON AND METHOD FOR PRODUCING A SHEET MATERIAL OF THE ALLOY

BACKGROUND OF THE INVENTION

The present invention relates to an aluminum alloy on which an oxide film having a light gray is formed by anodization and to a method for producing the aluminum alloy.

In order to provide a decorative affect and improve corrosion resistance of a sheet material made of an aluminum alloy used for building materials, equipment, decorations, and others, an anodic oxide film is formed on the sheet material by anodic treatment. The anodization provides various colors dependent on types of alloys.

However, the anodic oxide film often takes on irregular tone. Furthermore, the tone of the color is liable to change with the lot of the alloy.

For example, on an aluminum alloy containing iron (Fe) and silicon (Si) as essential elements for coloring, an anodic oxide film having a gray based color is formed by an ordinary anodization. When the material of such an aluminum alloy is cast, iron and silicon are precipitated as intermetallic compound such as $Al_3Fe$, $Al_6Fe$, $\beta$-AlFeSi, $\alpha$-Al(FeM)Si, and where M are transition elements included in the aluminum alloy as impurities. Content ratios of these precipitations vary in accordance with compositions of the alloy, casting conditions, soaking treatment, and rolling process Sometimes, these precipitations are oxidized at anodic treatment or remain in the anodic oxide film without oxidized. The presence of the mixture of these precipitations cause irregular tone and the color instability in the anodic oxide film. For example, the tone of the color of the anodic oxide film delicately changes so that the anodic oxide film having a stable color can not be formed.

Japanese Patent Application Laid Open 60-82642 discloses a method in which an aluminum alloy ingot is heated at high temperature for a long time for transforming the Al-Fe system intermetallic compound to a stable $Al_3Fe$ intermetallic compound in order to prevent the crystallization of some compounds which cause color instability.

Furthermore, there has been proposed a method in which an aluminum alloy ingot containing a large amount of iron is treated by soaking at low temperature so that $Al_6Fe$ is prevented from transforming to $Al_3Fe$, and only the intermetallic compound mainly consisting of $Al_6Fe$ is precipitated. Thus, a dark gray oxide film is formed on the aluminum alloy.

However, in the former process, the manufacturing cost increases and productivity is remarkably reduced because of the heat treatment at high temperature for a long period. The anodic oxide film does not take on gray, but takes on undesirable yellowish color. Since the color changes with the lot in dependence on a slight change of the conditions, it is necessary to strictly control the heating conditions of the ingot of the cast aluminum alloy.

In the latter process, the transformation of the Al-Fe system intermetallic compounds can be suppressed. However, the cast structure is not sufficiently homogenized at low temperature. Accordingly, the alloy having fine and uniform crystal structure is not obtained, and a stripe pattern tends to be formed on the anodized oxide film.

SUMMARY OF THE INVENTION

The object of the present invention is to provide an aluminum alloy on which an anodic oxide film of uniform light gray can be stably formed.

The aluminum alloy of the present invention consists of, by weight, from 0.08 to 0.50 percent silicon, from 0.15 to 0.90 percent iron, the weight ratio of iron to silicon being from 1.4 to 2.2, and the remainder aluminum, intermetallic compounds of $\alpha$-type Al-Fe-Si system being contained in the alloy.

An oxide film of light gray is formed on the alloy by anodic treatment.

The aluminum alloy may contain 0.001 to 0.10 percent titanium, 0.0001 to 0.02 percent boron, and 0.005 to 0.1 percent magnesium.

When the aluminum alloy of the present invention is cast by a known semi-continuous casting, only $\alpha$-AlFeSi and $\alpha$-Al(FeM)Si and the mixture thereof are precipitated as Al-Fe-Si system intermetallic compounds in the aluminum alloy ingot. These intermetallic compounds are hereinafter called $\alpha$-type compound in the specification. The $\alpha$-type compound exists stably against heat treatment performed after casting as described hereinafter.

A sheet material of aluminum alloy is produced by heating an ingot of the aluminum alloy to a temperature about 450° to 590° C. and maintaining it over one hour at a heated temperature, and by flattening the ingot by hot rolling and cold rolling. The aluminum alloy consists of, by weight, from 0.08 to 0.50 percent silicon, from 0.15 to 0.90 percent iron, the weight ratio of iron to silicon being from 1.4 to 2.2, and the remainder aluminum, intermetallic compounds of $\alpha$-type Al-Fe-Si system being contained in the alloy.

BRIEF DESCRIPTION OF DRAWINGS

The figure is a graph showing the influences of iron content and silicon content of an aluminum alloy on the precipitations in the alloy.

DETAILED DESCRIPTION OF THE PREFERRED EMBODIMENTS

The compositions of the aluminum alloy according to the present invention will be described hereinafter Silicon (Si) : Silicon is an element included in the aluminum alloy as an inevitable impurity and remarkably affects the color of the anodic oxide film. The silicon content is determined in the range of 0.08% to 0.5% by weight. If the silicon content exceeds 0.5 % by weight, coarse precipitation of silicon simple substance are liable to be produced. The silicon precipitations cause the color of anodized oxide film to be dark gray. If the silicon content is lower than 0.08% by weight, the coloring is insufficient.

Iron (Fe) : Iron is an important element to provide the $\alpha$-type compound such as $\alpha$-AlFeSi and $\alpha$-Al(FeM)Si and to form the anodic oxide film having light gray. The iron content is in the range of 0.15% to 0.90% by weight. If the iron content exceeds 0.90% by weight, the other intermetallic compounds than the $\alpha$-type compounds, such as $Al_6Fe$ and $Al_3Fe$, are liable to be precipitated, causing the color of the film to be unstable. If the iron content is less than 0.15% by weight, the $\alpha$-type compound necessary for providing light gray is not sufficiently precipitated.

Weight ratio of iron to silicon : It is very important factor to mainly precipitate the α-compound as Al-Fe-Si system intermetallic compound. The weight ratio of iron to silicon is determined in the range of 1.4 to 2.2. If the ratio is larger than 2.2, the Al-Fe system compound such as $Al_6Fe$ and $Al_3Fe$ is liable to be crystallized. If the content ratio is smaller than 1.4, a β-type compound such as β-AlFeSi and β-Al(FeM)Si and a free silicon simple substance are liable to be precipitated, which make the color of the anodic oxide film dark gray. Consequently, it is difficult to obtain a stable light gray anodic oxide film.

Titanium (Ti) and Boron (B) : Titanium is added to the aluminum alloy as an optional compound and serves to fine the cast structure of the alloy, thereby homogenizing the color of the anodic oxide film. The effect of titanium remarkably increases by adding boron. The titanium content is in the range of 0.001% to 0.10% by weight. The boron content is in the range of 0.0001% to 0.02% by weight. If the contents of titanium and boron are lower than 0.001% by weight and 0.0001% by weight, respectively, there is little titanium effect. If contents of titanium and boron exceed 0.10% by weight and 0.02% by weight, respectively, the fining of the structure is not effected. Furthermore, it is liable to produce coarse compounds of Al-Ti, Ti-B and Al-Ti-B system, causing the cracking of the cast alloy.

Magnesium (Mg) : A small amount of magnesium is added to the alloy in order to suppress the growth of fir tree structure formed on the surface of the ingot when casting. The fir tree structure is formed when molten metal in contact with an inner wall of a mold is intermittently cooled. This is caused by the precipitation of the Al-Fe system intermetallic compound near the surface of the ingot. The precipitation causes the color of the anodic oxide film after the anodic treatment to change. In order to obtain a normal surface, the fir tree structure formed on the surface is removed by the scalping machining before the hot rolling. When the aluminum alloy is cast under the ordinary conditions, the fir tree structure sometimes grows about 10 mm in the thickness from the surface of the ingot. The amount of the scalping is accordingly increased, which causes the yield to reduce, resulting in increase of the manufacturing cost. In the present invention, the magnesium content is determined in the range of 0.005% to 0.1% by weight, whereby, the fir tree structure is limited within 5 mm or less in thickness from the surface of the ingot. If the magnesium content exceeds 0.1% by weight, $Mg_2Si$ is precipitated to cause the change of the color of the anodic oxide film.

There are other impurities in the aluminum alloy, for example, copper, zinc, nickel, chromium, manganese and cobalt. These impurities do not affect the color of the film as far as the contents thereof are maintained in ordinary ranges. Concretely, the contents of the respective elements are, by weight, up to 0.2% of copper, up to 0.2% of zinc, up to 0.02% of nickel, chromium, manganese and cobalt.

These impurities are sometimes effective for improving the strength of the alloy. Although a part of these transition elements such as nickel, chromium, manganese and cobalt is combined with an α-AlFeSi system compound to form the α-Al(FeM)Si system compound, the compound does not affect the color of the anodic oxide film.

The inventors conducted experiments to examine the influence of iron and silicon contents, and weight ratio of iron to silicon of the aluminum alloy on the formation of the intermetallic compounds in the alloy. The figure shows the result of the experiments.

In order to obtain a test piece for the experiments, various amounts of iron and silicon are added to an aluminum alloy to produce ingots which are different in ratio of iron to silicon, by a semi-continuous casting. The ingot is treated by soaking at 530° C. for one hour. Thereafter, hot and cold rolling are performed to obtain a rolled alloy sheet. During the cold rolling, intermediate annealing is performed on the rolled alloy sheet at 390° C. for one hour. The test strip is obtained by cutting the rolled sheet. The peak of each of the intermetallic compounds in the test piece, such as the α-type compound, $Al_3Fe$, $Al_6Fe$, and β-type compound, is measured by the X-ray diffraction. In the experiments, almost all the α-type compound was α-Al(FeM)Si.

In the soaking treatment, the ingot of the cast aluminum alloy is held for one hour or more at a temperature in the range of 450° to 590° C.. If the temperature exceeds 590° C., a part of α-type compound is liable to transform to $Al_3Fe$ because of the separation of silicon. As a result, the color of the anodic oxide film becomes unstable. If the temperature is lower than 450° C., the cast structure is not sufficiently homogenized. Moreover, coarse grains and grain streaks are liable to be produced during the hot working. In order to sufficiently homogenize the structure, it is necessary to hold the alloy for 1 hour to 5 hours. If the holding time is shorter than 1 hour, heterogeneous structure remains in the alloy. If the holding time is longer than 5 hours, the homogeneity effect is saturated, increasing useless energy consumption.

Referring to the figure, mark ○ represents a value at which only the peak of the α-type compound is detected, the mark X represents a value at which the peak of either α-type, $Al_3Fe$ or $Al_6Fe$, is detected, and the mark Δ represents a value at which the peak either α-type compound, β-AlFeSi or free Si is detected.

A zone shown by hatched lines represents the composition of the alloy according to the present invention. In the zone, the silicon content is 0.08% to 0.50% by weight, the iron content is 0.15% to 0.90% by weight, and the weight ratio of iron to silicon is 1.4 to 2.2. Only the peaks of the α-type compounds are detected in the hatched zone. In the outside of the hatched zone, the peaks of the β-type compound, $Al_3Fe$, $Al_6Fe$ and free silicon are detected other than the α-type compound.

The examples of the experiments will be described hereinafter in detail.

Exampel 1

The example 1 uses alloys A to G o the table 1. Molten metal of each alloy is cast to produce an ingot of 508 mm in thickness and 1050 mm in width by the semi-continuous casting.

TABLE 1

| | Chemical Composition (Weight Percent) | | | | | |
|---|---|---|---|---|---|---|
| Alloy | Si | Fe | Ti | B | Fe/Si | |
| A | 0.12 | 0.20 | 0.02 | 0.002 | 1.7 | Present |
| B | 0.24 | 0.41 | 0.03 | — | 1.7 | Invention |
| C | 0.30 | 0.55 | 0.03 | — | 1.8 | |
| D | 0.35 | 0.69 | — | — | 2.0 | |
| E | 0.08 | 0.32 | 0.02 | — | 4.0 | Comparative |
| F | 0.12 | 0.55 | 0.03 | — | 4.6 | Example |

TABLE 1-continued

| Alloy | Chemical Composition (Weight Percent) Si | Fe | Ti | B | Fe/Si |
|---|---|---|---|---|---|
| G | 0.50 | 0.40 | 0.03 | — | 0.8 |

The alloy ingot is treated by soaking under the conditions o four types of that treatments a to d of the table 2. Thereafter, the hot rocking is performed on each ingot.

TABLE 2

| Treatment | Sorking Temperature (°C.) | Holding Time (h) | Rolling Start Temperature (°C.) |
|---|---|---|---|
| a | 480 | 2 | 472 |
| b | 530 | 1 | 515 |
| c | 540 | 3 | 515 |
| d | 590 | 1 | 480 |

Furthermore, the hot-rolled plate is subjected to intermediate annealing at 390° C. for one hour and the annealed plate is rolled by cold rolling to a sheet of 2 mm in thickness.

A test piece is obtained by cutting the cold-rolled sheet. The test piece is anodized using sulfuric acid as electrolytic solution to form an oxidation coating of 18 μm in thickness. The anodization is performed under he following conditions.

electrolytic bath: 15% sulfuric acid solution
electrolytic bath temperature : 25° C.
current density : 1.2 A/dm$^2$ The color of the anodic oxide film is measured by a calorimeter. Table 3 shows the results of the measurements.

TABLE 3

| Alloy | Soaking Condition | Strength of Peak of X-ray diffraction α-Compound | $Al_3Fe$ | $Al_6Fe$ | Si | Tone L | b | ΔL | Synthetic Estimation | |
|---|---|---|---|---|---|---|---|---|---|---|
| A | b | +++ | — | — | — | 86.0 | 0.4 | | ◎ | Present |
| | d | +++ | — | — | — | 86.2 | 0.4 | 0.2 | ◎ | Invention |
| B | a | ++++ | — | — | — | 82.0 | 0.7 | | ◎ | |
| | c | ++++ | — | — | — | 82.4 | 0.7 | | ◎ | |
| | d | ++++ | — | — | — | 82.2 | 0.8 | 0.4 | ◎ | |
| C | c | ++++ | — | — | — | 81.5 | 0.8 | | ◎ | |
| | d | ++++ | — | — | — | 81.2 | 0.9 | 0.3 | ◎ | |
| D | b | ++++ | — | — | — | 80.3 | 0.9 | | ○ | |
| | d | ++++ | — | — | — | 80.6 | 0.9 | 0.3 | ○ | |
| E | b | ++ | + | + | — | 83.5 | 1.2 | | Δ | Comparative |
| | d | — | +++ | — | — | 84.5 | 1.3 | 1.0 | Δ | Example |
| F | a | +++ | + | + | — | 80.5 | 1.2 | | × | |
| | c | ++ | ++ | + | — | 80.8 | 2.1 | | Δ | |
| | d | + | +++ | — | — | 82.5 | 2.0 | 2.0 | Δ | |
| G | c | ++ | — | — | + | 78.5 | 2.0 | | × | |
| | d | ++ | — | — | + | 79.2 | 2.1 | 0.7 | × | |

note: strength of peak represents in order of ++++> +++> ++> +

In the column of the tone, the value in the column L represents lightness of the anodic oxide film. As the value increases, the color becomes lighter. Value in the column b represents hue of the anodic oxide film. When the hue b is zero, the color of the anodic oxide films is completely light gray. As the value of the hue b increases, the color becomes more yellowish and as the hue b reduces, the color becomes more bluish. The number in the column ΔL represents the difference between the lightnesses L caused by difference in heat treatment of each ingot.

In the alloys A to D of the present invention, the each difference ΔL is small even if the temperature in the heat treatment is different from the others. The hue b of each alloy is smaller than 0.9. This means that oxide films has not yellow.

To the contrary, in the alloys E to G of the comparative example, if the heating condition is changed, the tone changes largely in spite of the same alloy. Furthermore, if the temperature of the heat treatment is high, the value of the lightness L becomes large, causing an increase of the difference ΔL. Moreover, the values of the hue b are large compared with those of the present invention. This means that the color of the anodic oxide films includes yellow.

According to the result of the X-ray diffraction tests, in each of the alloys A to D, α-Al(FeM)Si is detected at a high peak without influence of the temperature of the heat treatment. In the alloys E to G, peaks of $Al_3Fe$, $Al_6Fe$ and free silicon are detected other than the α-type compound. In addition, the peaks vary with the heating temperature of the ingot.

From the foregoing, it will be seen that when the aluminum alloys of the present invention are anodized, anodic oxide films take on pure and uniform light gray without mixing other colors. To the contrary, it will be seen that the anodic oxide films of each comparative example provides yellowish gray which differs from other alloys in dependence on the temperature of the treatment, so that the anodic oxide film having a stable color can not be produced.

In the table 3, synthetic estimation of the coloring of anodic oxide film is made for each alloy. The mark ◎ represents an aluminum alloy having a film of completely uniform light gray. The mark ○ represents an alloy having a film of approximately uniform light gray. The mark Δ represents an alloy having a film of a little irregular coloring and slightly yellowish gray. The mark X represents an alloy having a film of irregular coloring and yellowish gray.

The alloys marked ◎ and ∘ passed the examination and the alloys marked Δ and X were rejected. Example 2:

In the Example 2, alloys H to L having the compositions shown in the table 4 are used. Each alloy is cast in the same manner as the Example 1. The cast alloy is rolled to a cold-rolled sheet of 2 mm in thickness.

TABLE 4

| Alloy | Chemical Composition (Weight Percent) Si | Fe | Ti | Mg | Fe/Si | |
|---|---|---|---|---|---|---|
| H | 0.42 | 0.24 | 0.03 | 0.014 | 1.8 | Present |

TABLE 4-continued

| Alloy | Chemical Composition (Weight Percent) Si | Fe | Ti | Mg | Fe/Si | |
|---|---|---|---|---|---|---|
| I | 0.39 | 0.23 | 0.03 | 0.006 | 1.7 | Invention |
| J | 0.40 | 0.24 | 0.03 | 0.003 | 1.7 | Comparative |
| K | 0.41 | 0.24 | 0.03 | 0.002 | 1.7 | Example |
| L | 0.40 | 0.24 | 0.03 | 0.001 | 1.7 | |

The coloring of each anodic oxide film is measured in the same manner as the Example 1. The table 5 shows the results of the measurements. Furthermore, the fir tree structure provided in the cast alloy is examined and the thickness of the fir tree structure is measured.

The mark ○ represents the thickness of the fir tree structure smaller than 5 mm from the surface of the ingot of the cast aluminum alloy. The mark Δ represents the thickness between 5 and 20 mm. The mark X represents the thickness exceeding 20 mm.

TABLE 5

| Alloy | Peak of X-ray Diffraction α-compound | $Al_mFe$ | Growth of Fir Tree Structure Rate of Casting (mm/minute) 50 | 60 | 65 | 70 |
|---|---|---|---|---|---|---|
| H | ++++ | | ○ | ○ | ○ | – |
| I | ++++ | | ○ | ○ | – | – |
| J | +++ | + | Δ | Δ | – | – |
| K | ++++ | + | × | × | – | – |
| L | +++ | + | × | × | – | – |

From the foregoing, in the alloys H and I of the present invention containing 0.005% or ore of magnesium by weight, the growth of the fir tree structure is sufficiently suppressed less than 5 mm from the surface of the ingot. In the alloys J to L containing a larger amount of magnesium than the present invention, a maximum fir tree structure exceeds 20 mm. Consequently, the comparative example must be largely cut off in the surface of the ingot, which means reduction of the yield.

In accordance with the present invention, the iron content, silicon content, and weight ratio of iron to silicon of the alloy are adjusted to form the stable α-type compound such as α-AlFeSi and α-Al(FeM)Si by casting the alloy. The α-type compounds are not affected by the hot rolling condition or heat treatment conditions and stably remain in the alloy after the cold rolling. Accordingly, the anodic oxide film formed by anodization takes on homogeneous light gray without mixing with other colors. Alloys having the same quality can be produced without carrying out special color matching treatment. Furthermore, since the scalping amount of the ingot surface is reduced by adding small amount of magnesium, the yield increases, thereby reducing the manufacturing cost.

While the presently preferred embodiments of the present invention have been shown and described, it is to be understood that this disclosure is for the purpose of illustration and that various changes and modifications may be made without departing from the scope of the invention as set forth in the appended claims.

What is claimed is:

1. An aluminum alloy suitable for forming a light gray anodic oxide film thereon, consisting essentially of, by weight, from 0.08 to 0.50 percent silicon, from 0.15 to 0.90 percent iron, the weight ratio of iron to silicon being from 1.4 to 2.2, and the remainder aluminum, intermetallic compounds of α-type Al-Fe-Si system being uniformly contained in the alloy.

2. The aluminum alloy according to claim 1 further consisting of, by weight, from 0.001 to.0 10 percent titanium, and from 0.0001 to 0.02 percent boron.

3. The aluminum alloy according to claim 1 further consisting of, by weight, from 0.005 to 0.1 percent magnesium.

4. The aluminum alloy according to claim 2 further consisting of, by weight, from 0.005 to 0.1 percent magnesium.

5. A method for producing a sheet material of aluminum alloy consisting essentially of, by weight, from 0.08 to 0.50 percent silicon, from 0.15 to 0.90 percent iron, the weight ratio of iron to silicon being from 1.4 to 2.2, and the remainder aluminum, intermetallic compounds of α-type Al-Fe-Si system being uniformly contained in the alloy, comprising the steps of:

heating an ingot of the aluminum alloy to a temperature about 450° to 590° C. and maintaining it over one hour at a heated temperature; and flattening the ingot by hot rolling and cold rolling.

* * * * *